US009052149B2

(12) United States Patent
Bender

(10) Patent No.: US 9,052,149 B2
(45) Date of Patent: Jun. 9, 2015

(54) TRIGGER WITH ADJUSTABLE SHOE

(71) Applicant: Terrence Dwight Bender, Minneapolis, MN (US)

(72) Inventor: Terrence Dwight Bender, Minneapolis, MN (US)

(73) Assignee: Terrence Dwight Bender, Minneapolis, MN (US)

( * ) Notice: Subject to any disclaimer, the term of this patent is extended or adjusted under 35 U.S.C. 154(b) by 0 days.

(21) Appl. No.: 14/017,818

(22) Filed: Sep. 4, 2013

(65) Prior Publication Data

US 2014/0068989 A1 Mar. 13, 2014

Related U.S. Application Data

(60) Provisional application No. 61/743,429, filed on Sep. 4, 2012.

(51) Int. Cl.

| | |
|---|---|
| ***F41A 19/10*** | (2006.01) |
| ***F41A 19/09*** | (2006.01) |
| ***F41A 19/00*** | (2006.01) |

(52) U.S. Cl.

CPC ..... *F41A 19/00* (2013.01); *F41A 19/09* (2013.01); *F41A 19/10* (2013.01)

(58) Field of Classification Search

CPC ..... F41A 19/10; F41A 19/11; F41A 19/16; F41A 19/09

USPC ..... 42/85, 90, 106; 124/31

See application file for complete search history.

(56) References Cited

U.S. PATENT DOCUMENTS

| | | | | |
|---|---|---|---|---|
| 2,457,296 | A * | 12/1948 | Yawman | 42/69.01 |
| 2,920,413 | A | 1/1960 | Marhefka et al. | |
| 3,206,884 | A | 9/1965 | Purvis | |
| 4,005,540 | A | 2/1977 | Robinson | |
| 4,667,429 | A * | 5/1987 | Perazzi | 42/69.01 |
| 4,691,461 | A | 9/1987 | Behlert | |
| 4,955,155 | A | 9/1990 | Jones | |
| 5,018,292 | A | 5/1991 | West | |
| 5,503,137 | A * | 4/1996 | Fusco | 124/72 |
| 5,822,903 | A * | 10/1998 | Davis, Sr. | 42/69.01 |
| 6,164,001 | A | 12/2000 | Lee | |
| 6,298,594 | B1 * | 10/2001 | Strayer | 42/69.01 |
| 6,367,465 | B1 | 4/2002 | Buccieri, Jr. | |
| 6,651,642 | B1 * | 11/2003 | Powers | 124/35.2 |
| 7,188,561 | B1 | 3/2007 | Kelbly | |
| 7,992,338 | B2 * | 8/2011 | Bowman et al. | 42/90 |
| 2003/0228915 | A1 * | 12/2003 | Goko | 463/51 |
| 2005/0229911 | A1 * | 10/2005 | Simo et al. | 124/31 |
| 2006/0207149 | A1 * | 9/2006 | Lazor | 42/69.01 |
| 2009/0266348 | A1 | 10/2009 | Yeh | |
| 2011/0167691 | A1 * | 7/2011 | Bowman et al. | 42/1.01 |
| 2011/0167697 | A1 * | 7/2011 | Geissele | 42/69.03 |
| 2012/0117841 | A1 | 5/2012 | Joubert et al. | |
| 2013/0047484 | A1 * | 2/2013 | Wickser, Jr. | 42/95 |
| 2013/0167423 | A1 | 7/2013 | Lupher et al. | |
| 2013/0213376 | A1 * | 8/2013 | Kenworthy | 124/62 |
| 2013/0269233 | A1 * | 10/2013 | Chin | 42/69.01 |

* cited by examiner

*Primary Examiner* — Bret Hayes
*Assistant Examiner* — Derrick Morgan
(74) *Attorney, Agent, or Firm* — Vidas, Arrett & Steinkraus

(57) ABSTRACT

In some embodiments, a trigger comprises a finger portion comprising a plurality of detent locations and a shoe comprising a resiliently deformable detenting structure. The shoe is attachable to the finger portion at a plurality of predetermined positions via said resiliently deformable detenting structure occupying a detent location. The shoe is disengageble from a given position by resiliently deforming said resiliently deformable detenting structure.

20 Claims, 8 Drawing Sheets

TRIGGER WITH ADJUSTABLE SHOE

CROSS-REFERENCE TO RELATED APPLICATIONS

The application claims the benefit of U.S. Provisional Patent Application No. 61/743,429, filed Sep. 4, 2012, the entire content of which is hereby incorporated herein by reference.

BACKGROUND OF THE INVENTION

This invention relates to triggers and trigger assemblies, such as triggers for firearms.

Commercial firearms are often provided in stock form with a single trigger arrangement. Often shooters desire to have the trigger in their firearm differ from the stock trigger arrangement in one way or another—for example, a shooter may desire to lighten the trigger pull weight and/or to have a smoother trigger travel.

Another drawback to a stock trigger arrangement is that the trigger sizing and physical dimensions may not be optimal for various shooters. Hand size varies, and while a stock trigger may be suitable for an average hand size, a shooter with large hands may have difficulty with a stock trigger.

There remains a need for a trigger that is capable of fine trigger weight adjustment. There remains a need for a trigger that is capable of finger pad adjustment. Desirably, the trigger weight and/or finger pad location would be adjustable without disassembly of the firearm or any exchanges of parts.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a trigger comprises a finger portion comprising a plurality of detent locations and a shoe comprising a resiliently deformable detenting structure. The shoe is attachable to the finger portion at a plurality of predetermined positions via said resiliently deformable detenting structure occupying a detent location. The shoe is disengageable from a given position by resiliently deforming said resiliently deformable detenting structure.

In some embodiments, the resiliently deformable detenting structure comprises a detent protrusion and each of the plurality of detent locations comprises a detent recess. In some embodiments, the resiliently deformable detenting structure comprises a cantilever structure.

In some embodiments, the finger portion comprises a non-circular cross-section. In some embodiments, the shoe surrounds the finger portion. In some embodiments, the shoe comprises a cavity having a first aperture and a second aperture, said finger portion extending through said first aperture and said second aperture.

In some embodiments, the finger portion comprises a finger pad, and the detent locations are located opposite the finger pad.

In some embodiments, a second shoe is provided that is interchangeable with a first shoe, wherein the first shoe and second shoe have finger pads oriented differently from one another. In some embodiments, a distance between a cavity and the finger pad is greater on the second shoe.

In some embodiments, a trigger comprises a finger portion comprising a plurality of receptacle locations, a shoe and a fastener. The shoe is attachable to said finger portion at a plurality of predetermined locations, said fastener being received in a receptacle location and securing the shoe to the finger portion. In some embodiments, the fastener frictionally engages the receptacle. In some embodiments, the fastener and one or more receptacle locations are threaded.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
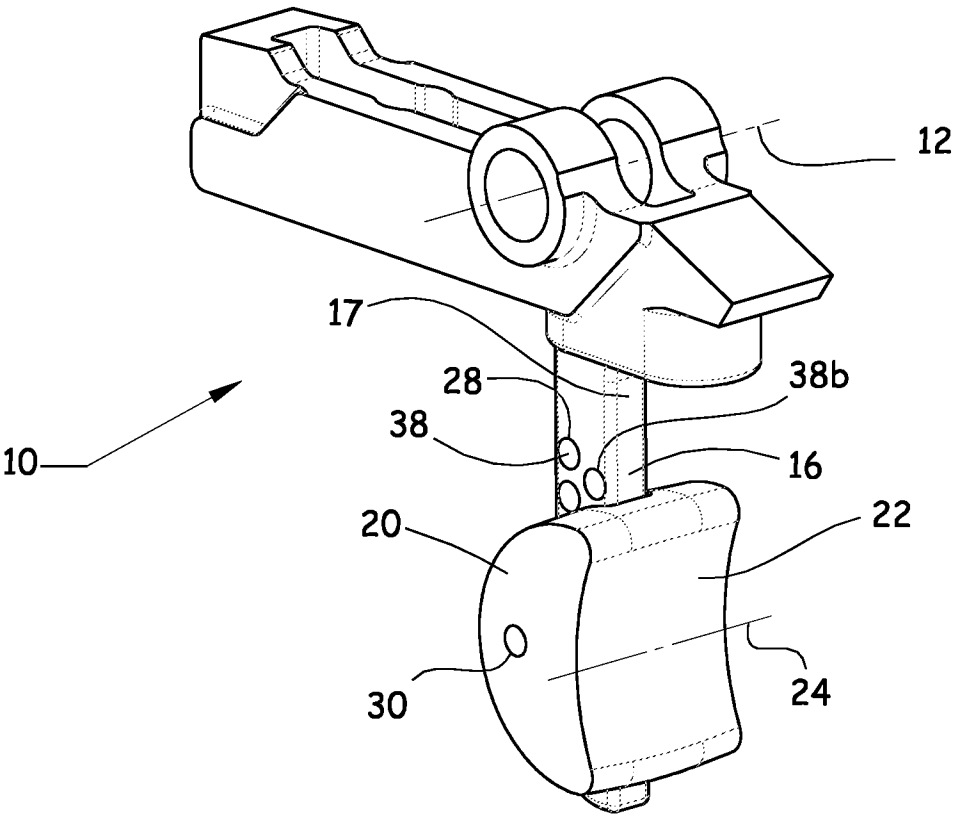
FIGS. 1 and 2 show an embodiment of a trigger having a shoe.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Trigger assemblies for firearms are known in the art. U.S. patent application Ser. No. 13/352,965, filed Jan. 18, 2012, teaches an example of a trigger assembly. U.S. patent application Ser. No. 13/352,965 is incorporated herein by reference in its entirety.

The trigger mechanism disclosed herein is compatible with the trigger assembly taught in U.S. patent application Ser. No. 13/352,965. In some embodiments, the trigger assembly disclosed herein comprises parts as described in U.S. patent application Ser. No. 13/352,965 (e.g. hammer, biasing springs, etc).

Desirably, a trigger can be adjusted to achieve fine tuning of trigger pull weight and/or fine tuning of the specific physical finger positioning required for proper use. Desirably, a single adjustment mechanism can provide for such adjustment, with no other changes to the trigger assembly, replacement of parts or disassembly of the firearm.

Figure 2:
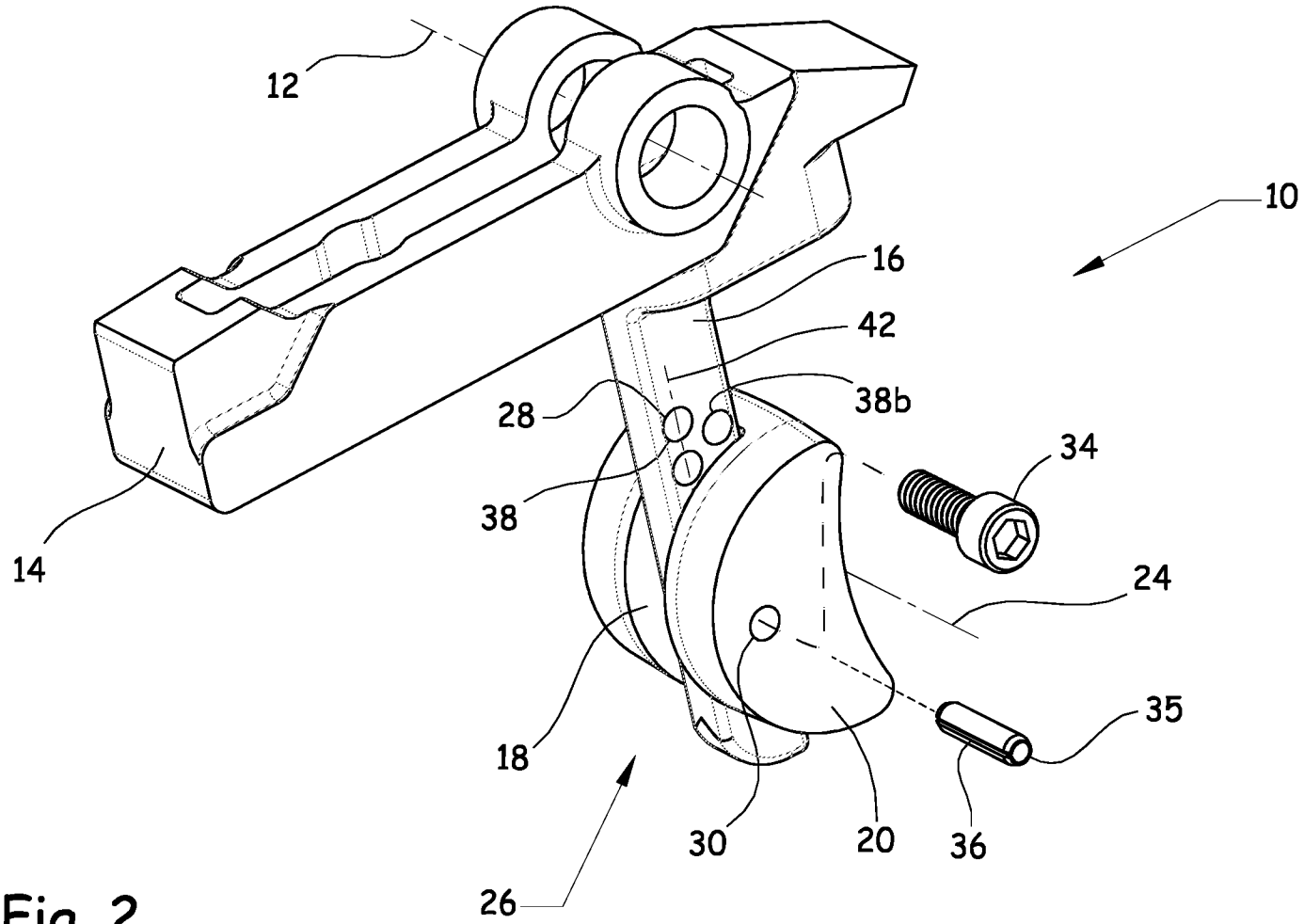

FIGS. 1 and 2 each show an embodiment of a trigger 10 comprising a shoe 20. In some embodiments, the trigger 10 is rotatable about a rotation axis 12 and comprises a sear surface 14. In some embodiments, the sear surface 14 is arranged to contact a hammer sear of a firearm hammer (not illustrated). The rotation axis 12 and sear 14 may be concealed within the body of a firearm. Desirably, the trigger 10 comprises a finger portion 16, which can comprise a cantilever structure that extends outward from the body of a firearm. The finger portion 16 can also be described as a trigger bow 16.

Desirably, the shoe 20 is attachable to the finger portion 16 at various locations along a length of the finger portion 16, and the position can be adjusted as desired by a user.

The trigger 10 can be made from any suitable material, such as metals, polymers, etc. The shoe 20 can similarly be made from any suitable material, such as metals, polymers, etc. In some embodiments, the trigger 10 comprises a metal and the shoe 20 comprises a polymer. In some embodiments, a color of the shoe 20 is different from a color of the trigger 10. In some embodiments, a shoe 20 is formed from a single piece of material. In some embodiments, a shoe 20 is formed by a molding process.

In some embodiments, the finger portion 16 is straight along its length (e.g. straight along a central longitudinal axis). The finger portion 16 can have any suitable cross-sectional shape. In some embodiments, a cross-sectional shape of the finger portion 16 is non-circular. In some embodiments, a cross-sectional shape of the finger portion 16 is rectangular or substantially rectangular. In some embodiments, the finger portion 16 comprises beveled or rounded edges. For example, as illustrated in FIGS. 1 and 2, the finger portion 16 comprises a substantially rectangular shape having radiused corners. In some embodiments, the cross-sectional shape of the finger portion 16 is constant throughout an adjustment range of the shoe 20. In some embodiments, the cross-sectional shape of the finger portion 16 is constant along its entire length.

Desirably, the shoe 20 comprises a finger pad 22 arranged for contact with a user's finger. In some embodiments, the finger pad 22 comprises curvature, for example being convex with respect to the finger portion 16 and concave with respect to a user's finger. In some embodiments, the finger pad 22 comprises curvature around an axis 24 oriented orthogonal to a central longitudinal axis of the finger portion 16. In some embodiments, the finger pad 22 is straight in directions parallel to the axis 24.

The finger pad 22 can have any suitable size and shape, and can have any degree of curvature.

In some embodiments, a width of the shoe 20 exceeds the width of the finger portion 16. In some embodiments, a width of the finger pad 22 exceeds the width of the finger portion 16. This allows for a reduction in the stress applied to a user's finger upon actuation of the trigger when the finger pad 22 is used, as the force is distributed across a larger area.

In some embodiments, the shoe 20 comprises a cavity 26 arranged to receive the finger portion 16. The cavity 26 can have any suitable shape and configuration, and can comprise an aperture, slot, blind hole, etc. In some embodiments, a shoe 20 partially surrounds the finger portion 16. In some embodiments, a cavity 26 is at least partially defined by opposed sidewalls. In some embodiments, one or more sidewalls 18 are planar. In some embodiments, a shoe 20 fully surrounds the finger portion 16.

In some embodiments, the shape of the cavity 26 engages the shape of the finger portion 16 and prevents rotation of the shoe 20 with respect to the finger portion 16. In some embodiments, a cross-sectional shape of the cavity 26 is similar to a cross-sectional shape of the finger portion 16. In some embodiments, the cross-sectional shapes can be dissimilar, but portions of the shoe 20 defining the cavity 26 abut the finger portion 16 to prevent rotation.

The shoe 20 can be attached to the finger portion 16 using any suitable method. Desirably, the attachment mechanism allows for easy repositioning of the shoe 20 with respect to the finger portion 16.

In some embodiments, the finger portion 16 comprises a plurality of recesses 28, such as apertures 38, blind holes, through holes, etc. In some embodiments, the shoe 20 comprises at least one aperture 30. The shoe 20 can be positioned such that a shoe aperture 30 is aligned with a finger portion aperture 38, and a suitable fastener can be used to engage the apertures 30, 38. Any suitable fastener can be used. In some embodiments, a fastener comprises a threaded fastener 34 such as a screw, bolt or the like. In some embodiments, an aperture 28 comprises complimentary threadings to engage a threaded fastener. In some embodiments, a fastener comprises a pin 35 arranged to engage the shoe 20, finger portion 16 or both. In some embodiments, a pin 35 frictionally engages the shoe 20, finger portion 16 or both. In some embodiments, a pin 35 comprises a spring pin, which can be compressed and inserted into the aperture(s) 30, 38, and the spring pin will resiliently expand to engage the shoe 20, finger portion 16 or both. In some embodiments, a spring pin 35 comprises a slot 36.

In some embodiments, at least some of the apertures 38 in the finger portion 16 are aligned along a straight axis 42, for example in a lengthwise direction of the finger portion 16. This allows the shoe 20 to be repositioned between locations that are aligned along the axis 42 (e.g. vertically aligned). In some embodiments, the finger portion 16 comprises one or more apertures **38*b* that are offset from the axis 42, or aligned on a second axis that is offset from the first axis 42. This allows for the shoe 20 to be repositioned between locations, wherein at least one location is offset from the axis 42 (e.g. vertically offset). This allows for adjustment of the shoe 20 in a direction non-parallel to the axis 42. For example, the adjustment can provide for changing the distance between the finger pad 22 and a front face 17 of the finger portion 16**.

Figure 3:
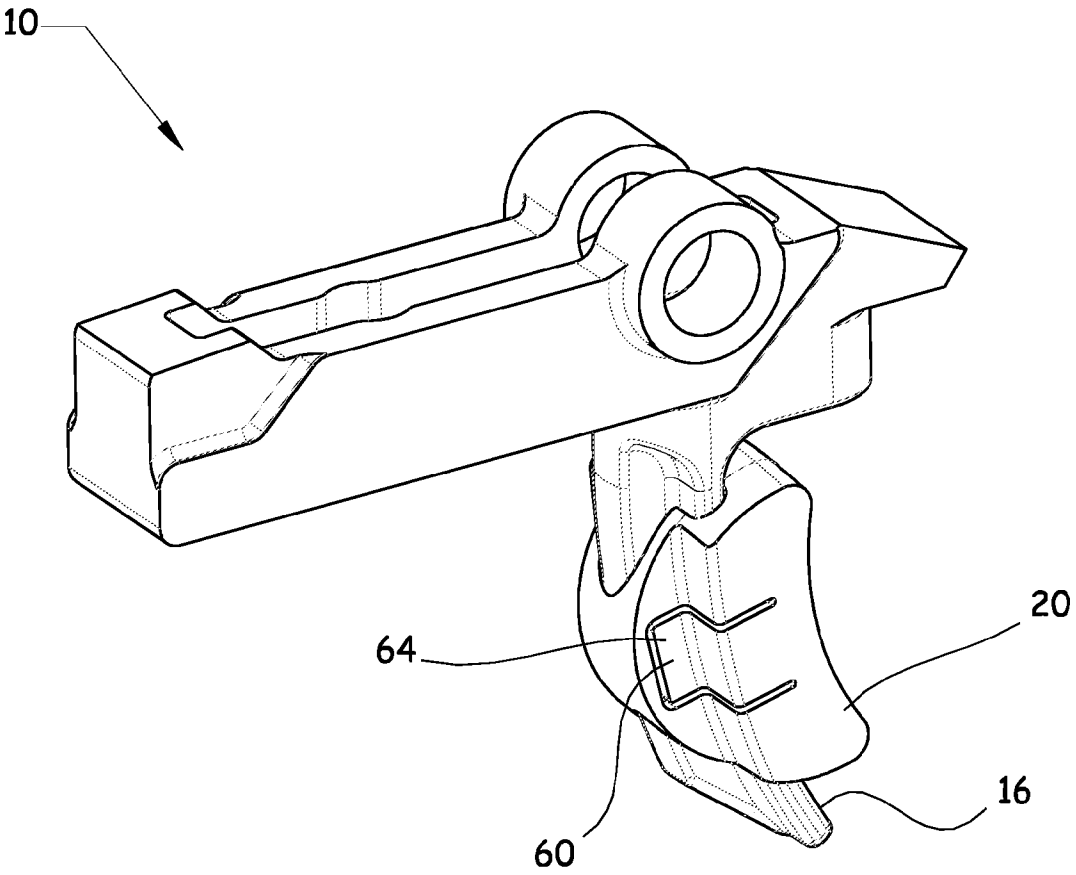
FIGS. 3 and 4 show another embodiment of a trigger having another embodiment of a shoe.
Figure 4:
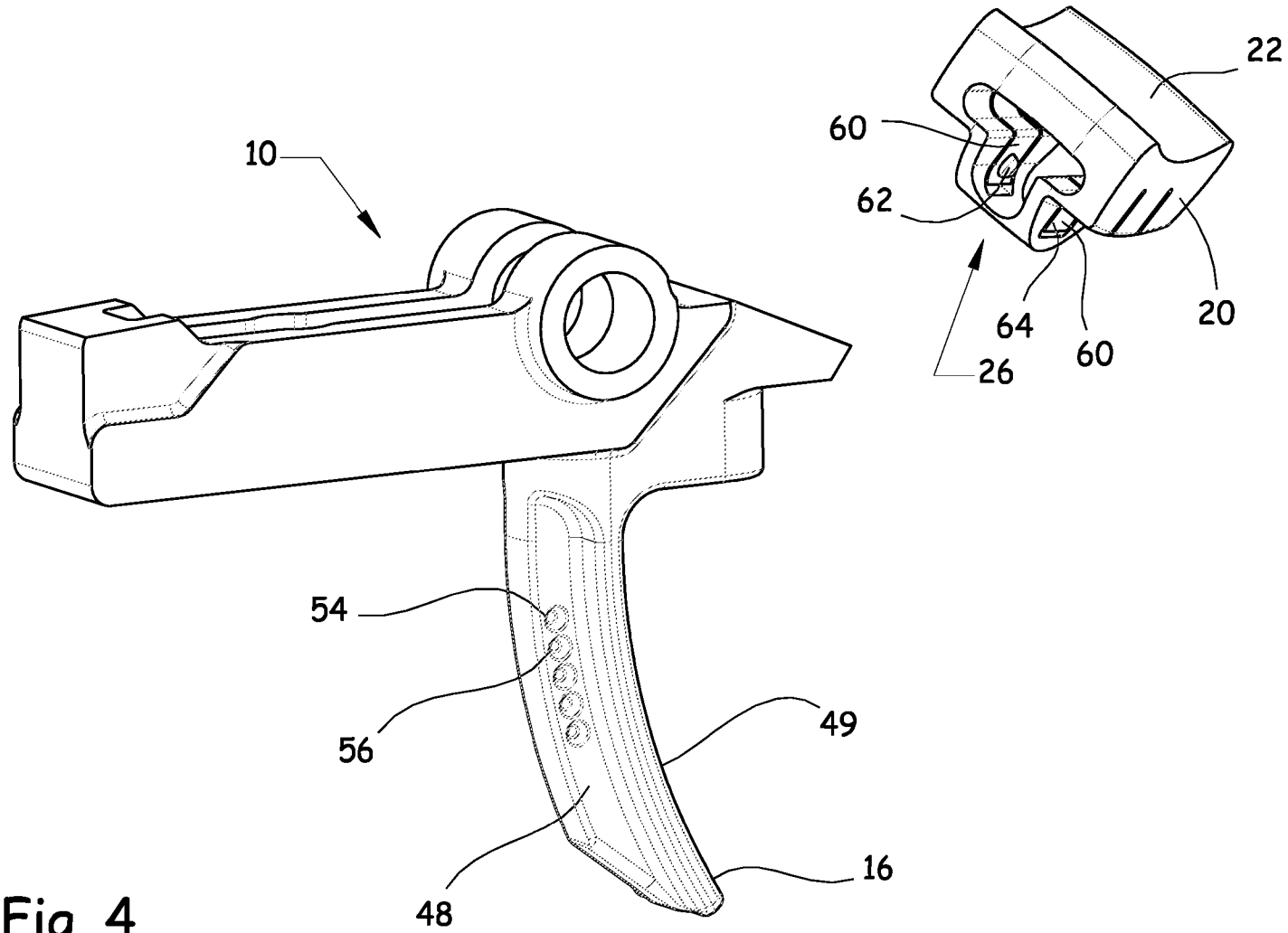

FIGS. 3 and 4 show another embodiment of a trigger 10 comprising another embodiment of a finger portion 16 and another embodiment of a shoe 20.

In some embodiments, the finger portion 16 comprises curvature along its central longitudinal axis. The finger portion 16 can be curved in any suitable direction, such as concave with respect to a user's finger (as shown in FIGS. 3 and 4), convex with respect to a user's finger, curved in a lateral direction, and combinations thereof.

In some embodiments, the front face 17 of the finger portion 16 comprises a finger pad. Thus, the trigger 10 can be used without a shoe 20 if desired. In some embodiments, the front face 17 comprises a suitable width to provide for comfortable trigger actuation. In some embodiments, the front face 17 comprises a curved surface.

In some embodiments, the finger portion 16 comprises a cross-sectional shape that is asymmetrical across at least one orthogonal axis. In some embodiments, the finger portion 16 comprises a triangular cross-section or a T-shaped cross-section, for example having a stem portion 48 and a flange portion 49. A flange portion 49 can provide a comfortable finger pad on the finger portion 16 when a shoe 20 is not being used. Similarly, a triangular cross-section can be arranged with a side providing a suitable finger pad. In some embodiments, the shaped cross-section is constant along a length of the finger portion 16.

Desirably, the shoe 20 comprises a cavity 26 having a cross-sectional shape that compliments the shape of the finger portion 16. In some embodiments, the shoe 20 partially or fully surrounds the finger portion 16. In some embodiments, wall portions of the cavity 26 abut the finger portion 16 and prevent rotation of the shoe 20 with respect to the finger portion 16. In some embodiments, the cavity 26 includes non-circular openings, for example being triangular or T-shaped. In some embodiments, the cavity 26 comprises a T-shaped cross-section.

In some embodiments, a cavity 26 comprises curvature along its central axis. In some embodiments, the longitudinal curvature of the cavity 26 is similar to the longitudinal curvature of a finger portion 16 along its central longitudinal axis.

In some embodiments, the cavity 26 comprises an aperture and the body of the shoe 20 fully surrounds the aperture. Thus, in some embodiments, the shoe 20 fully surrounds the finger portion 16.

In some embodiments, finger portion 16 and shoe 20 are arranged to provide for a plurality of detent locations, wherein the shoe 20 can be repositioned between different detent locations. Thus, in various embodiments, one of the finger portion 16 or shoe 20 can be provided with a plurality of detent locations (e.g. recesses, notches, etc) and the other can be provided with a detenting structure, such as an interfering member arranged to engage a detent location. Any suitable structure for achieving a detenting interaction between the finger portion 16 and shoe 20 can be used.

As shown in FIG. 4, the finger portion 16 comprises a plurality of detent locations 54. A detent location 54 can have any suitable configuration, such as comprising a ridge, slot, hole, etc. In some embodiments, each detent location 54 comprises a recess 56 formed in the finger portion 16. In some embodiments, recesses 56 can have a non-cylindrical shape, for example being spheroidal, elliptical, conical, frustoconical, etc. Desirably, non-cylindrically shaped recesses 56 can allow for easier repositioning of the shoe 20 between detent locations.

In some embodiments, a detent location 54 comprises a pair of recesses 54. The structure illustrated in FIG. 4 includes recesses 56 aligned with one another on opposing sides of the finger portion 16. In some embodiments, the recesses 56 are provided on the stem portion 48 of a finger portion 16 having a T-shaped cross-section.

Desirably, the shoe 20 comprises a detenting structure 60 arranged to engage a detent location 54 of the finger portion 16. In some embodiments, a detenting structure 60 comprises a protrusion 62 arranged to be received in a detent location 54. Desirably, the shape of a protrusion 62 is complimentary to the shape of a detent location 54. In some embodiments, a detenting structure 60 comprises a resiliently deformable portion 64 that can be temporarily deformed in order to disengage the detenting structure 60 from a detent location 54. For example, in some embodiments, a detenting structure 60 can comprise a resiliently deformable tab or arm structure that comprises a protrusion 62. When the shoe 20 is engaged to a detent location 54, an application of an appropriate force in an appropriate direction can cause deformation of the resiliently deformable portion 64, allowing the detenting structure 60 to disengage from the detent location 54. As the shoe 20 moves and the detenting structure 60 becomes positioned over another detent location 54, the resiliency of the resiliently deformable portion 64 will return the shoe 20 to its original shape and the detenting structure 60 engages the new detent location 54. In some embodiments, a shoe 20 can be repositioned without tools.

In some embodiments, the finger portion 16 and shoe 20 are arranged to be engaged via multiple detenting structures 60, which each engage a separate detent location 54. The shoe 20 shown in FIGS. 3 and 4 comprises a pair of detenting structures 60 arranged to engage opposing sides of the finger portion 16.

Desirably, the finger portion 16 and shoe 20 are configured such that force applied to the shoe 20 by a user's finger when shooting a firearm will not deform the resiliently deformable portion 64 of the detenting structure 60.

Figure 5:
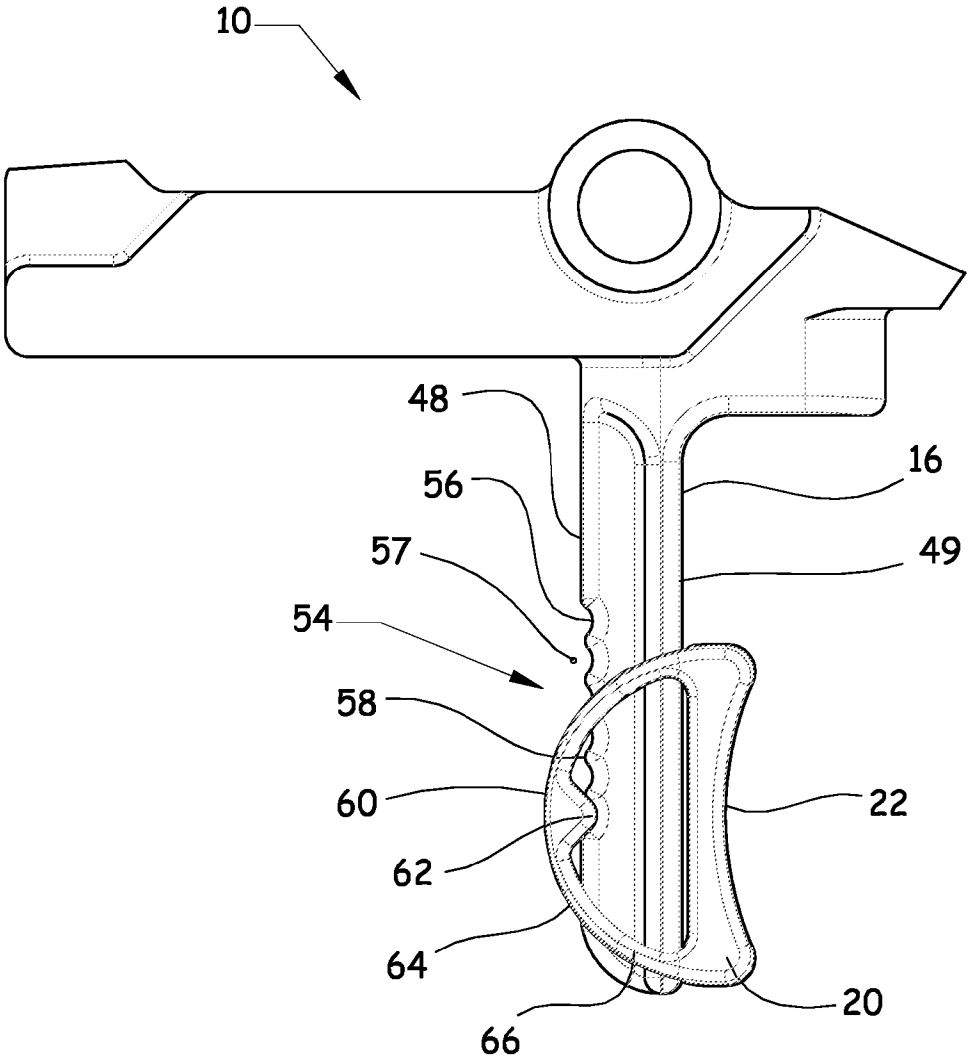
FIGS. 5 and 6 show another embodiment of a trigger having another embodiment of a shoe.
Figure 6:
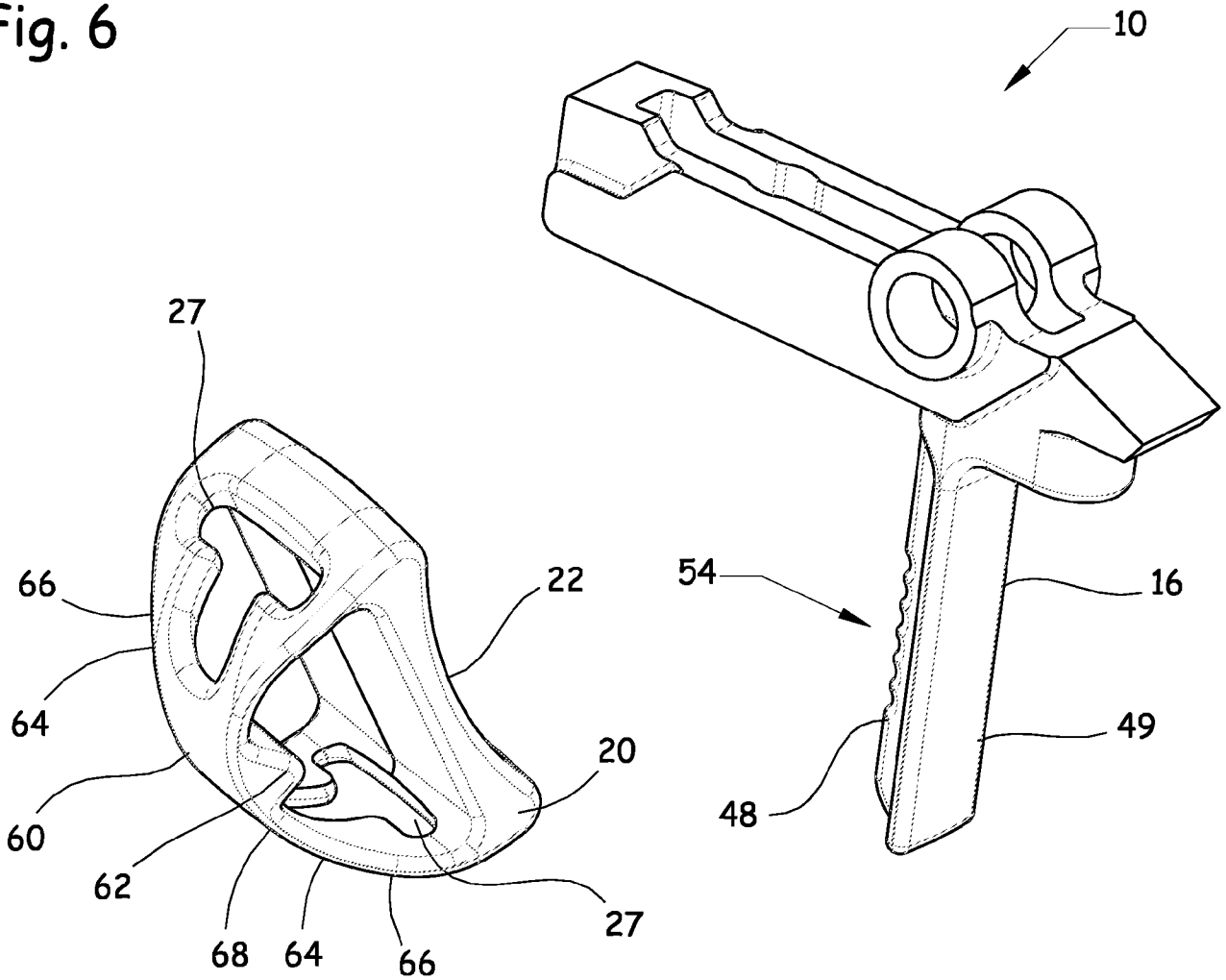
Figure 8:
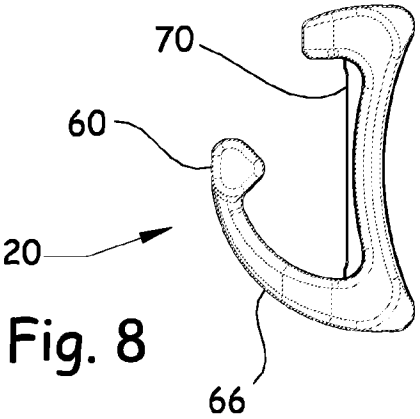
FIGS. 7-10 show views of another embodiment of a trigger shoe.
Figure 10:
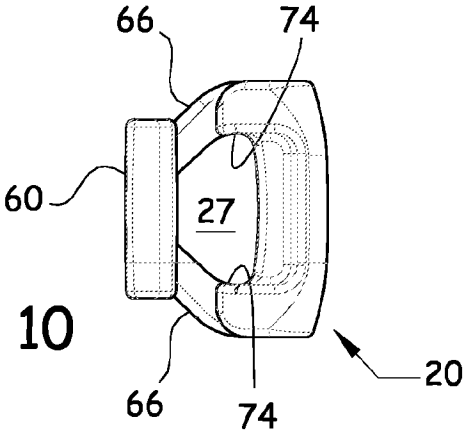
Figure 7:
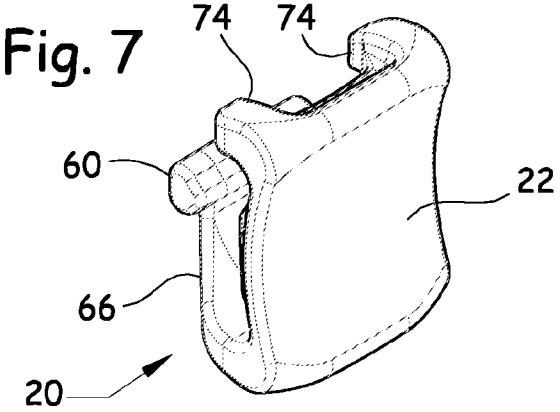
Figure 9:
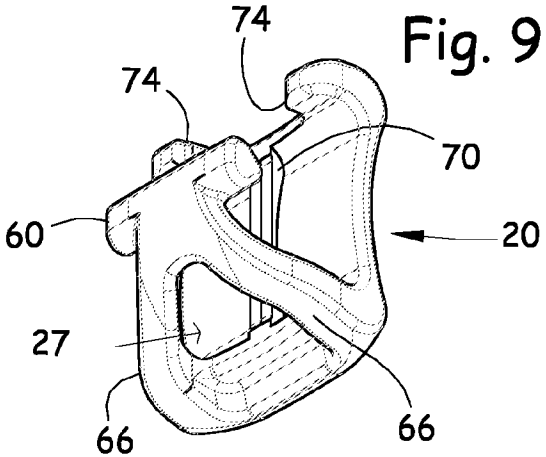

FIGS. 5 and 6 show another embodiment of a trigger 10 comprising another embodiment of a finger portion 16 and another embodiment of a shoe 20.

The finger portion 16 shown in FIGS. 5 and 6 comprises a front face 17 suitable for use as a finger pad when a shoe 20 is not being used.

In some embodiments, detent locations 54 on the finger portion 16 are located on a rear face (e.g. opposite the front face 17).

In some embodiments, a finger portion 16 is straight along its length and comprises a T-shaped cross-section, for example having stem 48 and flange portions 49. In some embodiment, detent locations 54 comprise recesses 56 having ridges 58 therebetween. In some embodiments, detent locations 54 are formed in a rear surface of the finger portion 16 (e.g. formed in a surface opposite the surface contacted by a shooter's finger). In some embodiments, detent locations 54 are formed at the bottom of the stem portion 48 of a T-shaped cross-sectional shape. In some embodiments, a recess 56 defines an arcuate or semi-tubular shape. In some embodiments, a recess 56 comprises curvature about an axis 57 oriented orthogonal to a central longitudinal axis of the finger portion 16. In some embodiments, a recess 56 is also straight in a direction parallel to the axis 57.

In some embodiments, a front portion of a shoe 20 comprises a finger pad 22 and a rear portion 68 of the shoe 20 comprises a detenting structure 60, for example comprising a protrusion 62 shaped complimentary to the recesses 56. In some embodiments, the detenting structure 60 is attached to the finger pad 22 portion of the shoe 20 via a plurality of connector members 66 or arms. In some embodiments, the rear portion 68 and/or the connector members 66 comprise a resiliently deformable portion 64 that provide for movement between detent positions upon an appropriate application of force.

In some embodiments, the detenting structure 60 is provided on the shoe 20 at a location opposite the finger pad 22. In some embodiments, the shoe 20 comprises one or more apertures 27 shaped to receive the finger portion 16. In some embodiments, an aperture 27 is non-circular, for example being triangular, rectangular or T-shaped. Desirably, a shape of the aperture 27 is complimentary to a shape of the finger portion 16, such that the perimeter of an aperture 27 can engage the finger portion 16 and help to secure the shoe 20 upon the finger portion 16.

FIGS. 7-10 show various views of another embodiment of a shoe 20, which is configured to engage a finger portion 16 having detent locations 54 on a rear surface of the finger portion 16, for example as shown in FIGS. 5 and 6.

In some embodiments, a detenting structure 60 comprises a cantilever structure attached to a body of the shoe 20. In some embodiments, the detenting structure 60 is attached via one or more connectors 66, wherein the connectors 66 are oriented to one side (e.g. below) of the detenting structure 60. In some embodiments, an aperture 27 formed in the shoe 20 is at least partially defined by one or more connectors 66. In some embodiments, a portion of a connector 66 abuts the finger portion 16. In some embodiments, a shoe 20 comprises a structural rib 70 to add strength. In some embodiments, a structural rib 70 is located behind the finger pad 22.

In some embodiments, a shoe 20 further comprises flange members 74 arranged to contact the finger portion 16. In some embodiment, opposed flange members 74 are arranged to contact opposed sides of the finger portion 16.

Figure 11:
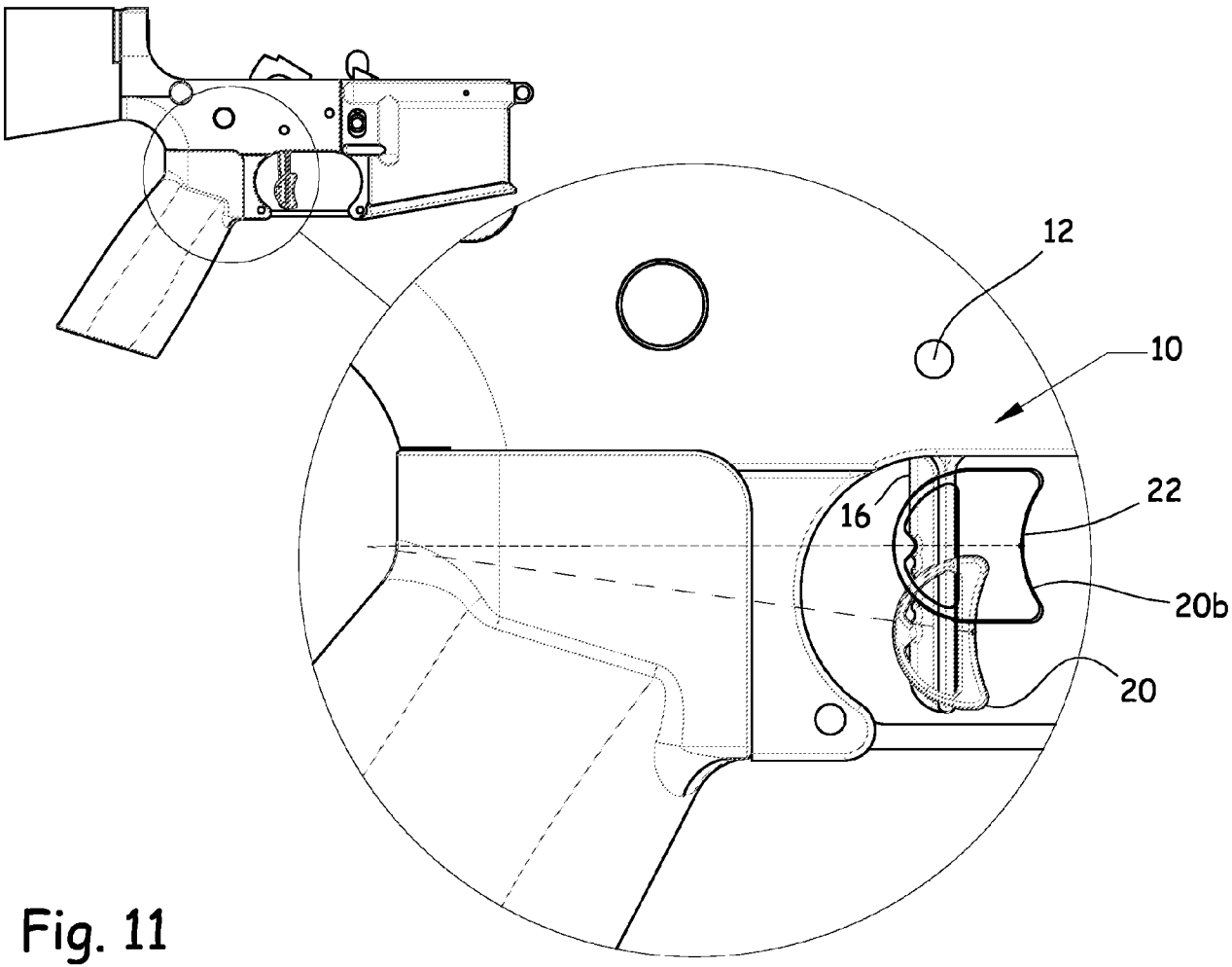
FIG. 11 shows a trigger and shoe installed in a firearm.

FIG. 11 shows an embodiment of a trigger 10 installed in an AR lower receiver, and also shows two embodiments of a shoe 20. In some embodiments, multiple shoes 20 can be provided, wherein the shoes 20 differ from one another. The first shoe 20 in FIG. 11 is similar to the shoe 20 depicted in FIGS. 5 and 6. The second shoe 20*b* comprises a larger body portion, wherein the finger pad 22 is located farther away from the cavity 26 that receives the finger portion 16. The second shoe 20*b* moves the finger pad 22 forward compared to the first shoe 20, and can accommodate shooters having larger hands/fingers.

FIG. 11 also shows how changing the position of a given shoe 20 along the length of the finger portion 16 will vary the distance between the shoe 20 and the pivot axis 12 of the trigger 10. Thus, adjustment of the shoe 20 location changes the moment arm of the torqueing force applied to the trigger 10 by the shooter's finger during trigger actuation, which in turn changes the amount of force that must be applied by the finger to the trigger to achieve actuation. A greater distance between the pivot axis 12 and the finger pad 22 reduces the required trigger pull weight.

It should be noted that the detenting structures described herein can be reversed in configuration. For example, a shoe 20 can comprise a detent recess and a finger portion 16 can comprise a plurality of detent location protrusions. Similarly, a finger portion 16 can comprise a single protrusion and a shoe 20 can comprise a plurality of detent recesses; or a finger portion 16 can comprise a single recess and a shoe 20 can comprise a plurality of detent protrusions. Additionally, in some embodiments, multiple detents can be engaged for each predetermined location. For example, a plurality of recesses can be provided on a finger portion 16 and a plurality of protrusions can be provided on a shoe 20. When the shoe 20 is at a first location, a first protrusion can be engaged to a first recess and a second protrusion can be engaged to a second recess. When the shoe 20 is at a second location, the first protrusion can be engaged to the second recess and the second protrusion can be engaged to a third recess, etc.

In some embodiments, a finger portion 16 comprises a resiliently deformable detenting structure and a shoe comprises one or more detent locations (e.g. recesses).

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A trigger comprising:

a trigger member comprising a trigger bow; and a shoe supported by said trigger member and moveable along a length of said trigger bow;

wherein one of said trigger bow or said shoe comprises a resiliently deformable detenting structure, and the other of said trigger bow or said shoe comprises a plurality of detent locations;

said shoe being attachable to said trigger bow at a plurality of positions via said resiliently deformable detenting structure occupying a detent location, said shoe disengageble from a given position by resiliently deforming said resiliently deformable detenting structure; and wherein said resiliently deformable detenting structure comprises one of a protrusion or a recess and each of said detent locations comprises the other of a protrusion or a recess.

2. The trigger of claim 1, wherein said resiliently deformable detenting structure comprises a protrusion and each of said detent locations comprises a recess.

3. The trigger of claim 1, wherein said trigger bow comprises said resiliently deformable detenting structure and said shoe comprises said plurality of detent locations.

4. The trigger of claim 1, wherein said shoe comprises said resiliently deformable detenting structure and said trigger bow comprises said plurality of detent locations.

5. The trigger of claim 1, wherein said trigger bow comprises a non-circular cross-section.

6. The trigger of claim 1, wherein said trigger bow comprises a T-shaped cross-section.

7. The trigger of claim 6, wherein said detent locations are located on a base portion of said T-shape.

8. The trigger of claim 5, wherein said shoe comprises a cavity having a non-circular opening.

9. The trigger of claim 1, wherein said shoe comprises a first shoe comprising a first cavity and a first finger pad, said first finger pad separated from a central axis of said first cavity by a first distance, said trigger further comprising a second shoe interchangeable with said first shoe, said second shoe comprising a second cavity and a second finger pad, said second finger pad separated from a central axis of said second cavity by a second distance, said second distance greater than said first distance.

10. The trigger of claim 1, wherein said shoe is formed from a single piece of material.

11. The trigger of claim 1, wherein said shoe is wider than said trigger bow.

12. A trigger comprising:

a trigger member comprising a trigger bow comprising a plurality of detent locations; and a shoe comprising a resiliently deformable detenting structure;

said shoe supported by said trigger member and moveable along a length of said trigger bow;

wherein said shoe is attachable to said trigger bow at a plurality of positions via said resiliently deformable detenting structure occupying a detent location, said shoe disengageable from a given position by resiliently deforming said resiliently deformable detenting structure; and wherein said resiliently deformable detenting structure comprises one of a protrusion or a recess and each of said detent locations comprises the other of a protrusion or a recess.

13. The trigger of claim 12, wherein said resiliently deformable detenting structure comprises a detent protrusion and each of said plurality of detent locations comprises a detent recess.

14. The trigger of claim 12, wherein said shoe is formed from a single piece of material.

15. The trigger of claim 12, wherein said resiliently deformable detenting structure comprises a cantilever structure.

16. The trigger of claim 12, wherein said shoe is wider than said trigger bow.

17. The trigger of claim 12, wherein said trigger bow comprises a non-circular cross-section.

18. The trigger of claim 12, wherein said trigger bow comprises a finger pad portion, and said detent locations are located opposite said finger pad portion.

19. The trigger of claim 17, wherein said shoe comprises a cavity having at least one non-circular opening.

20. The trigger of claim 12, said shoe comprising a finger pad, wherein said finger pad and said resiliently deformable detenting structure are oriented on opposite sides of said shoe.

* * * * *